US005468175A

United States Patent [19]

Nilén

[11] Patent Number: 5,468,175

[45] Date of Patent: Nov. 21, 1995

[54] DISHWASHER WHEREIN LIQUID IS CIRCULATED WITH GRANULES AND SEPARATION DEVICE FOR SEPARATING GRANULES FROM THE LIQUID

[75] Inventor: Bengt Nilén, Lund, Sweden

[73] Assignee: Viptop AB, Lund, Sweden

[21] Appl. No.: 108,673

[22] PCT Filed: Feb. 28, 1992

[86] PCT No.: PCT/SE92/00123

§ 371 Date: Nov. 8, 1993

§ 102(e) Date: Nov. 8, 1993

[87] PCT Pub. No.: WO92/15237

PCT Pub. Date: Sep. 17, 1992

[30] Foreign Application Priority Data

Mar. 1, 1991 [SE] Sweden ..... 9100594

[51] Int. Cl.[6] ..... B24C 3/00

[52] U.S. Cl. ..... 451/87; 451/88; 451/89

[58] Field of Search ..... 451/87, 88, 89, 451/101, 38, 39, 40; 134/57 D, 56 D, 58 D, 103.1, 103.2, 104.2, 108, 109

[56] References Cited

U.S. PATENT DOCUMENTS

| | | | |
|---|---|---|---|
| 1,600,001 | 9/1926 | Hoevel | 51/425 |
| 1,601,147 | 9/1926 | Ruemelin | 51/426 |
| 4,610,113 | 9/1986 | Fageroos | 51/425 |
| 5,049,260 | 9/1991 | Spears | 51/425 |

FOREIGN PATENT DOCUMENTS

| | | |
|---|---|---|
| 0195959 | 10/1986 | European Pat. Off. . |
| 464387 | 4/1991 | Sweden . |
| WO84/03616 | 9/1984 | WIPO . |

*Primary Examiner*—Maurina T. Rachuba
*Attorney, Agent, or Firm*—Young & Thompson

[57] ABSTRACT

A dishwasher for washing with granules heavier than liquid, comprises a washing chamber (1), a device (7) for spraying washing liquid with or without granules against dishes in the washing chamber, a tank (10) which is connected to an outlet (11) from the washing chamber, and a circulation pump (5), the suction side of which is joined to an outlet (4) from the tank, and the pressure side of which is joined to a manifold (6) for conducting liquid sucked in from the tank, with or without granules, to the spray device (7). According to the invention, the dishwasher comprises a dividing wall (8), defining an upwardly open tank chamber (12) in the tank. The upper edge of the wall is disposed beneath the upper limit of the tank. Furthermore, the outlet opening (11) of the washing chamber is disposed above the tank chamber (12) defined by the dividing wall.

9 Claims, 2 Drawing Sheets

DISHWASHER WHEREIN LIQUID IS CIRCULATED WITH GRANULES AND SEPARATION DEVICE FOR SEPARATING GRANULES FROM THE LIQUID

FIELD OF THE INVENTION

The present invention relates to a heavy-duty dishwasher for washing with granules heavier than liquid, comprising a washing chamber, a spray device for spraying washing liquid, with or without granules, against articles to be washed in the washing chamber, a tank which is Joined to an outlet from the washing chamber, and a circulation pump, the suction side of which is joined to an outlet from the tank and the pressure side of which is Joined to means for conducting liquid sucked into the tank, with or without granules, to the spray device.

A number of heavy-duty dishwashers are previously known in which blast particles or granules together with the washing liquid are thrown or sprayed against the articles to be washed.

BACKGROUND OF THE INVENTION

EP-A1-0 016 895 reveals a heavy-duty dishwasher of this type, which contains in its tank a granule collecting sieve container with its inlet connected to the washing chamber and its outlet connected to the suction chamber of the pump. A gate closes in one end position the outlet of the sieve container and thereby opens a connection between the suction chamber and portions of the tank lying outside the sieve container, so that only liquid is sucked up by the pump: In the other end position of the gate, said connection is closed and the pump sucks liquid from the tank via the sieve container, whereby the liquid sucked in has granules from the sieve container. In addition to the fact that such a dishwasher has relatively complicated construction, it requires time consuming maintenance in order to prevent the sieve container from being clogged by food particles carried by the circulating liquid.

EP-A2-0 195 959 and EP-A1-0 169 847 show dishwashers of the above-mentioned type for granules heavier than the washing liquid. In such machines, a vertically moveable cylinder is disposed at the bottom outlet of the tank. In the upper position of the cylinder, liquid and granules flow from the tank through the annular gap between the lower end of the cylinder and the bottom outlet of the tank. This gap is closed when the cylinder is in its lower position, where liquid from the tank is sucked in through a gap between the upper end of the cylinder and a conical plate which prevents granules from flowing from above into the upper open end of the cylinder. The dishwasher according to EP-A2-0 195 959 also contains an annular sieve plate in the last mentioned gap in order to prevent granules from accompanying liquid sucked into the upper end of the cylinder. In EP-A1-0 169 847, it is assumed that the granules will sink by their own weight to the bottom of the tank, and that only liquid will be sucked into the upper end of the cylinder when the cylinder assumes its lower end position. However, granules which pass by the upper end of the cylinder when it serves as a pump inlet will be sucked into the inlet, and therefore it takes a relatively long time for such a machine to assume a state where only liquid is circulated and all the granules have sunk to the bottom of the tank.

SUMMARY OF THE INVENTION

The present invention is intended to achieve a heavy-duty dishwasher using granules, said dishwasher not containing any sieve element to prevent granules from accompanying liquid sucked into the pump; and which can be immediately switched from a state where liquid with granules is sucked up by the pump to a state where only liquid is sucked into the pump, and which also has a simple and sturdy design with few components.

For this purpose, a heavy-duty dishwasher of the type described by way of introduction is characterized in that it comprises a dividing wall, defining an upwardly open chamber in the tank, the upper edge of said wall being disposed beneath the upper limit of the tank and that the outlet opening of the washing chamber is disposed above the chamber defined by the dividing wall. In this dishwasher, the upper edge of the dividing walls serves as a spillway and it allows liquid supplied to the chamber defined in the tank to overflow to the portion of the tank lying outside said chamber, while granules will sink due to gravity to the bottom of the chamber. Due to the fact that the overflow from this chamber to the portion of the tank lying outside the chamber occurs essentially at the surface of the liquid held in the chamber, the granules sinking in the chamber will only be given a small horizontal component of movement due to surface flow, and this means that all of the granules falling down from the washing chamber will sink to the bottom of the tank chamber.

In a preferred embodiment of the invention, the dividing wall at its lower end comprises a portion which can be pivoted between the first position in which the tank chamber defined by the wall is closed at its lower end, and a second position in which the lover portion of the tank chamber is in communication with the rest of the tank. Furthermore, the lower portion of the tank is preferably tapered to a bottom outlet and the lower end of the dividing wall is disposed to one side of and above the bottom outlet of the tank. By this design, the dishwasher can easily switch between washing with and without granules in the circulating washing liquid, at the same time as the positioning of the dividing wall away from the bottom outlet means that the flow about the bottom outlet will not, or only minimally, be effected by the operation of the pivoting portion of the dividing wall.

BRIEF DESCRIPTION OF THE DRAWINGS

The invention will now be described in more detail with reference to the accompanying drawings, in which.

Figure 2:
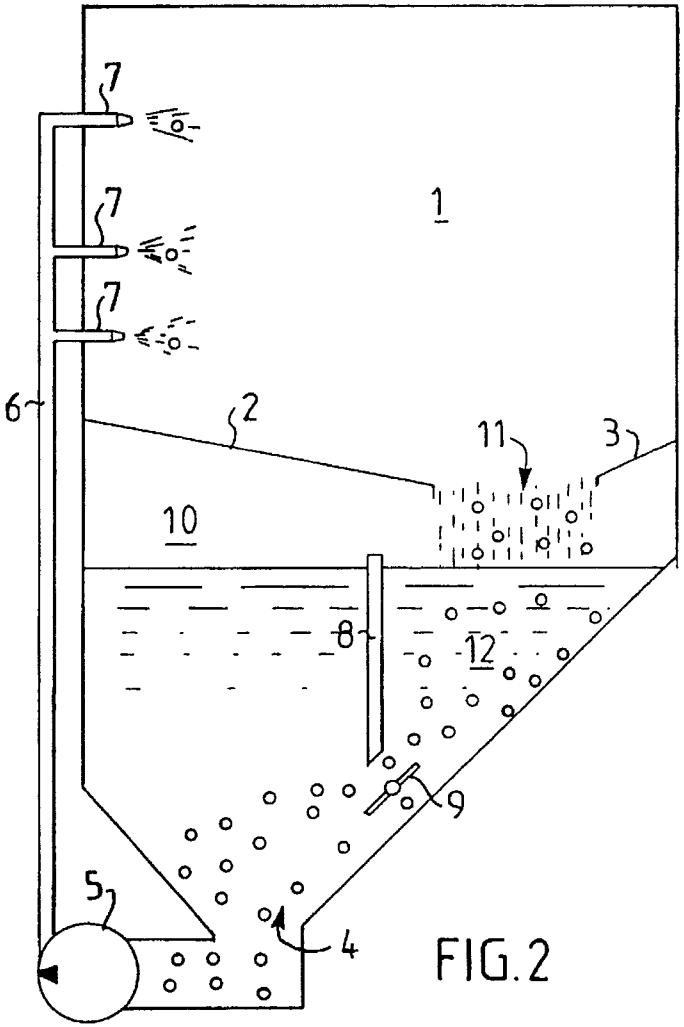
FIG. 2 shows a similar cross-section of the dishwasher in FIG. 1 while washing with granules in the washing liquid, and FIGS. 3–5 each show schematically a cross-sectional view of the tank in FIG. 1 with different variations of a dividing wall arranged therein.
Figure 1:
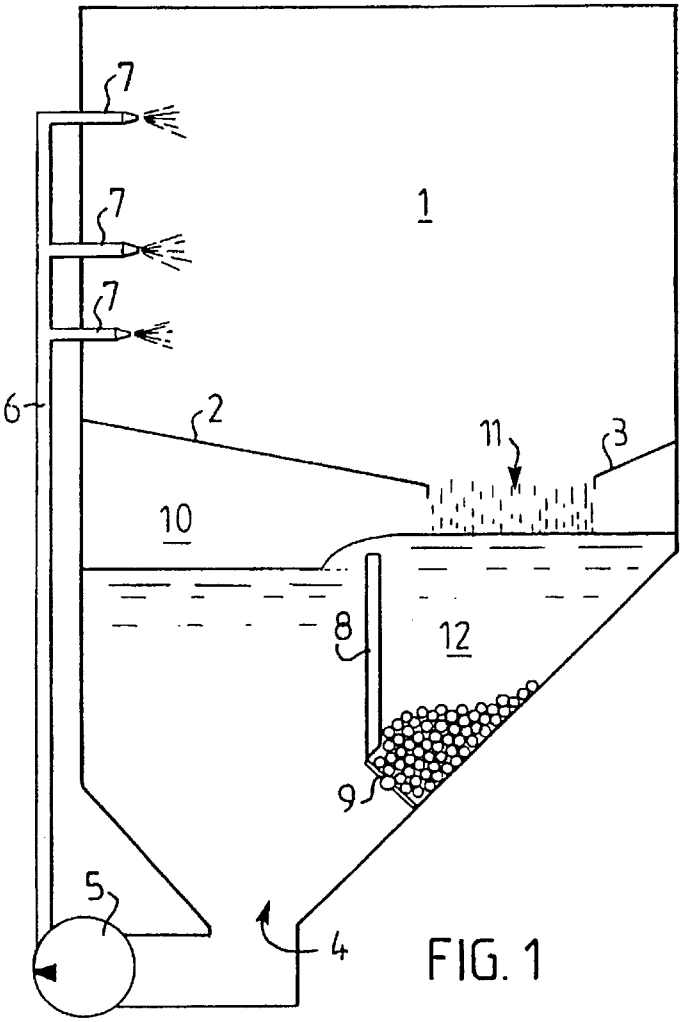
FIG. 1 shows schematically a cross-sectional view of a preferred embodiment of a heavy-duty dishwasher according to the invention while washing solely with washing liquid.

The heavy-duty dishwasher shown in FIGS. 1 and 2 comprises a washing chamber 1, in which the dishes to be washed can be placed in a suitably manner and held in place. An outlet from the washing chamber is defined by two bottom plates 2 and 3. In the present case, the washing chamber is rectangular and the bottom plates extend between the walls of the tank leaving a rectangular outlet opening 11. The bottom plates 2, 3 are also somewhat inclined in order to make sure that liquid and granules falling thereon will be led to the outlet opening 11.

Beneath the washing chamber there is a tank 10 with a bottom outlet 4. Preferably, the tank tapers at its bottom towards the bottom outlet.

The dishwasher also comprises a circulation pump 5, which is connection on its suction side to the bottom outlet 4 of the tank. The pressure side of the pump 5 is Joined to manifolds 6, of which only one is shown in the figures, from which manifolds the nozzles 7 extend. In order to understand the present invention, it is sufficient to know that the nozzles are arranged to direct and spray liquid sucked up by the pump against the dishes in the washing chamber, and therefore the description will not deal in detail with the arrangement of the pipes and nozzles.

The tank 10 has a dividing wall 8 which defines an upwardly open tank chamber 12. The outlet opening 11 from the washing chamber is located above the tank chamber 12. The dividing wall 8 extends parallel to the longitudinal sides of the rectangular outlet opening 11, i.e. perpendicular to the cross-sectional plane of the figures, and is laterally spaced from said opening.

At its lower portion, the dividing wall 8 has a pivoting portion, which in the embodiment shown consists of a gate 9 pivotable above a central axis. This gate can extend between the tank walls and thus constitute the entire lower portion of the dividing wall or can be an integrated portion of the lower portion of the dividing wall and be hinged thereto. The gate 9 can also be hinged about its upper or lower end, but the embodiment shown in FIGS. 1 and 2 is preferable since the gate 9 can be rotated between its closed and open positions by always rotating the gate in the same direction. In other words, no reversable pivot mechanism is required. The pivot mechanism for the gate 9 is of suitable type and is designed so that the gate will either assume the position shown in FIG. 1, in which the lower end of the tank chamber 12 is closed by the gate, or the position shown in FIG. 2, in which the lower end of the chamber 12 is open and connects the tank chamber 12 to the rest of the tank. Suitably, actuation of the pivot mechanism for the gate results in the gate being turned a quarter revolution, for example with the aid of a stepping motor.

The function of the heavy-duty dishwasher shown is quite simple. The pump 5 sucks liquid from the lower portion of the tank 10 and the liquid sucked in is sprayed through the nozzles 7 against the dishes in the washing chamber. The liquid then falls down to the bottom of the washing chamber and flows through the outlet opening 11 down into the chamber 12 of the tank 10. If the lower end of the tank chamber is closed and if the liquid level in the tank chamber lies below the upper edge of the dividing wall 8, this chamber will be filled to the upper edge of the wall and then overflow over said edge and into the rest of the tank 10. This circulation pattern is shown in FIG. 1.

FIG. 2 shows the circulation pattern when the lower end of the tank chamber 12 is open, i.e. when the gate 9 has been turned a quarter turn relative to the position shown in FIG. 1. Due to the fact that the tank chamber now communicates with the rest of the tank, the liquid levels in the tank chamber 12 and the rest of the tank will be evened out, and this means that a liquid flow corresponding to the liquid flow supplied to the tank chamber 12 via the outlet opening 11 will flow through the open lower end of the dividing wall 8 into the rest of the tank 10. Thus, essentially only the liquid in the tank chamber 12 and in the lower portion of the tank 10 will participate in the liquid circulation shown in FIG. 2.

In FIGS. 1 and 2, the round rings symbolize the blast particles or granules which are mixed into the washing liquid and which are heavier than said liquid, for example plastic granulate. In normal washing in the dishwasher shown, the granules are mixed into the liquid sucked in by the pump 5 and sprayed together with the liquid against the dishes so that the blasting effect will knock off burned-on or dried-on food residue from the dishes. The heavy-duty dishwasher is then in the above-described mode shown in FIG. 2.

After finished washing with the granules, the dishes must be rinsed with liquid alone in order to wash off the granules which may have stuck to the dishes or to the walls of the washing chamber. To do this it is sufficient to close the lower end of the tank chamber 12 by turning the gate 9 a quarter turn from the position shown in FIG. 2. The granules mixed with the liquid at the lower portion of the tank will accompany the liquid sucked into the pump, while the granules, which are mixed with the liquid in the chamber 12, will sink by gravity to the bottom of said chamber. By closing the tank chamber 12, initially no liquid will be supplied to the portion of the tank outside the tank chamber 12, and the liquid level there will drop until the tank chamber 12 is filled. Thereafter, there will be a flow as large as the flow sucked through the bottom outlet of the tank, which will flow over the upper edge of the dividing wall 8.

By dimensioning the dividing wall and placing it in such a manner that the volume of the tank chamber 12, which in the circulation mode shown in FIG. 2 extends above the liquid surface in the tank chamber and must thus be filled before liquid overflows the upper portion of the dividing wall, is at least as great as the sum of the volume of the lower portion of the tank outside the tank chamber, containing liquid mixed with granules, and the volume of the pipe system between the tank and the washing chamber, it is possible to assure that all of the granules have been returned to the tank chamber 12 before the liquid begins to overflow the upper edge of the dividing wall.

For such an arrangement it is, however, not necessary to assure that granules accompanying the liquid flowing out from the outlet opening 11 are not drawn with liquid overflowing the upper edge of the dividing wall. Due to their kinetic energy, the granules will quickly pass through a surface layer of the liquid in which the lateral flow takes place without being imparted in any appreciable horizontal component of movement and then sink by gravity to the bottom of the chamber 12 where they are collected as shown in FIG. 1. Near the upper edge of the dividing wall 8, the lateral flow is however sufficiently strong to pull granules with it, and therefore the dividing wall should be laterally spaced from the outlet opening 11.

It is evident from the above that the heavy-duty dishwasher described here can be operated with a higher level of filling than that shown in FIGS. 1 and 2, in other words with a liquid level lying above the upper edge of the dividing wall 8. With such a level of filling, when washing with liquid without granules, only surface flow will arise in the liquid surface and the stronger flow in the vicinity of the upper edge of the dividing wall is eliminated. When washing with liquid containing granules there arises, in addition to flow through the open lower end of the dividing wall as was described previously with refence to FIG. 2, a surface flow as well. For reasons mentioned previously, this surface flow will not appreciably effect the movement of the granules.

In order to give the granules sufficient kinetic energy to achieve the required blast effect when the granules are sprayed against the dishes, the pump 5 must have large capacity, and this means that the suction in the bottom outlet 4 of the tank 10 must be quite powerful. This creates a powerful turbulent flow in the vicinity of the bottom outlet. This turbulent flow means that the granules, which when the gate 9 is turned from the closed to the open position, flow in high concentration out of the lower end of the tank chamber, will very quickly be distributed more or less evenly in the liquid above the bottom outlet, and the steady state shown in FIG. 2 when washing with granules, in which the granules are relatively evenly distributed in the circulating liquid, will be achieved shortly after the gate is opened. As can be seen in FIGS. 1 and 2, the volume of the tank chamber 12 is less than the volume of the rest of the tank 10. This means that the liquid flow between the tank chamber 12 and the rest of the tank which occurs to replace the liquid sucked up by the pump will be sufficiently strong to provide the granules with the significant horizontal component of movement, and this also contributes to achieving an even granular distribution relatively quickly.

Figure 3:
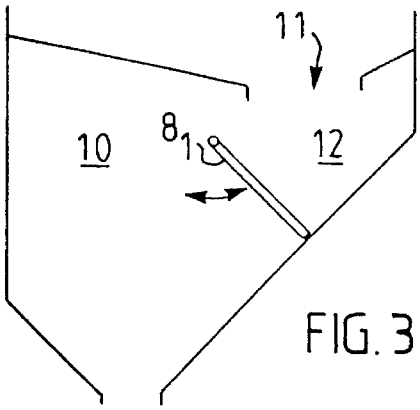
Figure 4:
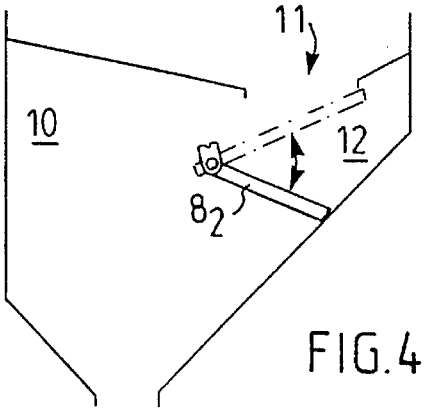
Figure 5:
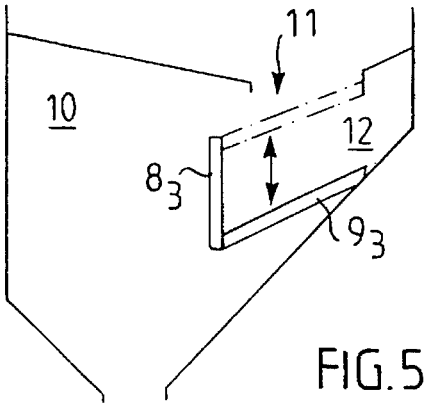

FIGS. 3–5 show variants of the dividing wall 8. FIG. 3 shows a dividing wall $\mathbf{8}_1$ which can be pivoted between a vertical position and a position in which the lower edge of the dividing wall is in contact with the tank wall and closes off a chamber 12 in the tank. The pivotability of the dividing wall $\mathbf{8}_1$ is indicated by an arrow in FIG. 3. This variant functions in principle in the same manner as the embodiment according to FIGS. 1 and 2.

FIG. 4 shows a dividing wall $\mathbf{8}_2$ which is pivotable between a lower position in which it closes off a tank chamber 12 and an upper position in which it is in contact with one edge of the outlet opening 11. Functionally this variant differs from that in FIGS. 1 and 2 by virtue of the fact that when washing with granules, the granules are supplied from above to the portion of the tank 10 containing the bottom outlet, and that the granules are imparted a horizontal component of movement by rolling down an inclined plane instead of being acted on by a liquid flow.

In FIG. 5, a dividing wall $\mathbf{8}_3$ is shown, comprising a bottom portion $\mathbf{9}_3$ which is vertically moveable between a lower and an upper position. Functionally, this variant functions in principle in the same manner as that shown in FIG. 4.

In a variant not shown, the entire dividing wall or a lower portion thereof is vertically moveable to open the lower portion of the chamber in the tank which said wall defines. This variant functions in the same manner as the embodiment according to FIGS. 1 and 2.

By making the washing chamber with bottom plates which define an outlet opening, it is possible to empty the dishwasher of granules in an elegant manner prior to cleaning thereof by placing a straining cloth sack in the outlet opening.

The dishwasher embodiments described can of course be modified in a number of ways within the scope of the invention. For example, the washing chamber and the tank can have other cross-sectional shapes than those described and shown, and the outlet of the tank could be arranged in a lateral wall of the tank. Furthermore, the outlet opening need not extend between the walls of the washing chamber but can be completely defined by the bottom plates and also be non-rectangular, which permits a corresponding modification of the horizontal cross-section of the tank chamber defining dividing wall. The invention will therefore only be limited by the scope of the attached patent claims.

I claim:

1. Heavy-duty dishwasher for washing with granules heavier than liquid, comprising a washing chamber, a spray device for spraying washing liquid against articles to be washed in the washing chamber, a tank which is joined to an outlet opening from the washing chamber, a circulation pump having a suction side joined to a bottom outlet from the tank and a pressure side joined to means for conducting liquid sucked in from the tank to the spray device, and a dividing wall defining an upwardly open tank chamber for storing granules heavier than liquid in the tank, said dividing wall having an upper end disposed beneath the upper limit of the tank, and the outlet opening of the washing chamber being disposed above the tank chamber defined by the dividing wall, said dividing wall at its lower end comprising a portion pivotable between a first position in which the tank chamber defined by the wall is closed at its lower end, and a second position in which the lower portion of the tank chamber is in communication with the rest of the tank, said lower portion of the tank being tapered to the bottom outlet, and said lower end of the dividing wall being located spaced laterally from and higher than the bottom outlet.

2. Dishwasher according to claim 1, wherein the outlet opening of the washing chamber is horizontally spaced from the upper end of the dividing wall.

3. Dishwasher according to claim 1, wherein the pivotable portion of the dividing wall is a gate.

4. Dishwasher according to claim 3, wherein the gate is rotatable about a central axis.

5. Dishwasher according to claim 1, wherein the dividing wall is pivotable about its upper end.

6. Dishwasher according to claim 5, wherein the dividing wall is pivotable between a first position in which it is in contact with one edge of the outlet opening of the washing chamber, and a second position, in which it is in contact with the tank wall and delimits a chamber in the tank.

7. Dishwasher according to claim 1, wherein the dividing wall comprises a vertically movable portion, which is movable between a first position in which it is in contact with the tank wall to delimit a chamber, and a second position in which it is in contact with one edge of the outlet opening of the washing chamber.

8. Dishwasher according to claim 1, wherein the dividing wall is vertically movable in its entirety.

9. Dishwasher according to claim 1, wherein a lower portion of the dividing wall is vertically movable.

* * * * *